United States Patent [19]

MacPherson et al.

[11] 4,286,400

[45] Sep. 1, 1981

[54] PICTURE FRAME AND MANUFACTURE THEREOF

[75] Inventors: James A. MacPherson; Joseph Schwartz, both of New York, N.Y.

[73] Assignee: Avant Modes, Inc., New York, N.Y.

[21] Appl. No.: 174,013

[22] Filed: Jul. 31, 1980

[51] Int. Cl.[3] ..... G09F 1/12

[52] U.S. Cl. ..... 40/152; 40/154

[58] Field of Search ..... 40/152, 152.1, 154, 40/156, 157

[56] References Cited

U.S. PATENT DOCUMENTS

| | | | |
|---|---|---|---|
| 273,378 | 3/1883 | Miller | 40/152 |
| 480,953 | 8/1892 | Mauerhofer | 40/152 |
| 697,872 | 4/1902 | Oldenbusch | 40/152 |
| 2,603,017 | 7/1952 | Merrill | 40/152 |
| 2,697,889 | 12/1954 | Heim | 40/152 |
| 3,956,838 | 5/1956 | Gerrish | 40/154 |
| 4,165,573 | 8/1979 | Richards | 40/152 |

*Primary Examiner*—Gene Mancene
*Assistant Examiner*—Wenceslao J. Contreras
*Attorney, Agent, or Firm*—Brooks, Haidt, Haffner & Delahunty

[57] ABSTRACT

A device for displaying an article which comprises a front frame part, a back frame part and a decorative covering over the face of the front frame part and held thereon by reason of clamping engagement of interfitting rims on the two parts with the decorative covering. The parts have aligned openings for viewing the article, such openings being covered by a transparent sheet for protecting the article. Supporting means for the frame assembly is secured to the back part and includes an easel which may have a loop for suspending the frame assembly or includes a stand. The easel or the stand are shaped so as to provide a cavity between it and the back part for receiving the article and the protective sheet.

19 Claims, 17 Drawing Figures

PICTURE FRAME AND MANUFACTURE THEREOF

This invention relates to devices for displaying and protecting articles and particularly, to devices commonly known as picture frames which are used to display photographs, paintings and other articles.

Picture frames are well known in the art and usually comprise various materials defining an opening which may or not be covered with a transparent sheet of glass or a plastics material. The frame may be decorated or plain, and the article, such as a picture, to be displayed is mounted within the frame by various means, such as a mat and a backer. The frame and picture assembly has a support, such as a loop, wire or easel for supporting the assembly in the desired position.

If the frame is made of several parts to be joined together manually, the frame is relatively expensive. Similarly, decorated frames usually are relatively expensive because of the labor involved or because relatively expensive machinery is required to make them.

It is known in the findings art that various items can be decorated relatively simply and inexpensively by covering the viewed surface of a part with a decorative covering and by clamping the covering to the part. However, none of such parts are, as far as we are aware, suitable for use as a picture frame because of the structures thereof which adapt them specifically for other intended uses.

It is one object of the invention to provide a decorated frame for displaying and protecting various articles such as photographs, pictures, etc., which may be manufactured relatively simply and easily and which may be mounted in the same manner as a picture frame.

In accordance with the preferred embodiment of the invention, the frame of the invention comprises a pair of interfitting, relatively rigid parts with an opening therein through which an article may be viewed. The front one of the parts is covered by a sheet of decorative material which is held on the front part by the other, back part, the sheet being clamped between the two parts. One of the parts, usually the back part, has a supporting means secured thereto for supporting the frame in the desired position. The supporting means provides a cavity into which an article to be displayed may be inserted. The supporting means may have a transparent portion which covers the openings in the frame to protect the article or a separate transparent sheet or film may be inserted in said cavity between the openings and the article.

Other objects and advantages of the present invention will be apparent from the following detailed description of the presently preferred embodiments thereof, which description should be considered in conjunction with the accompanying drawings in which.

Figure 1:
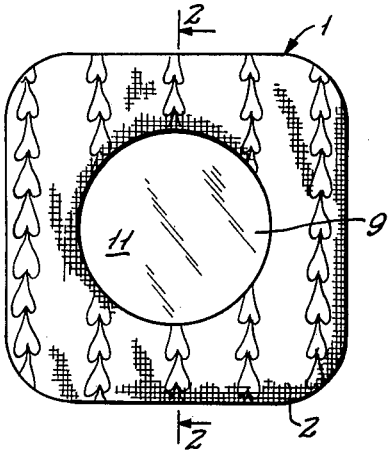
FIGS. 1 and 2 are, respectively, front elevation and cross-sectional views of a preferred embodiment of the invention, FIG. 2 being taken along the line 2—2 shown in FIG. 1.
Figure 2:
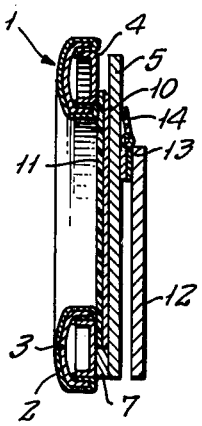
Figure 4:
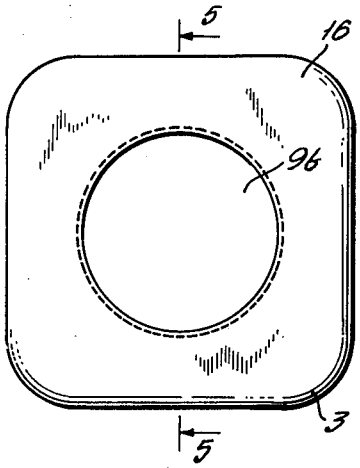
Figure 5:
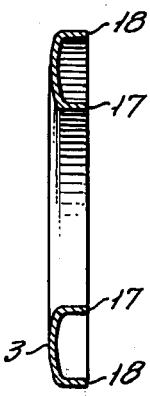
Figure 6:
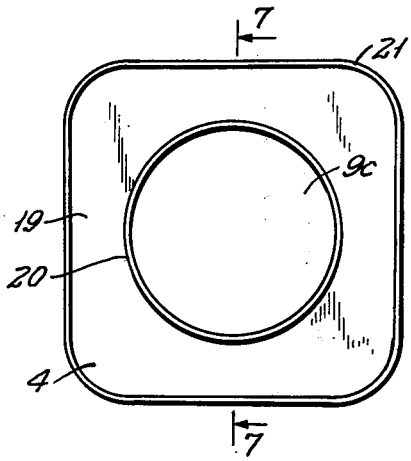
Figure 7:
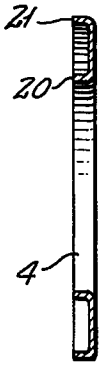
Figure 8:
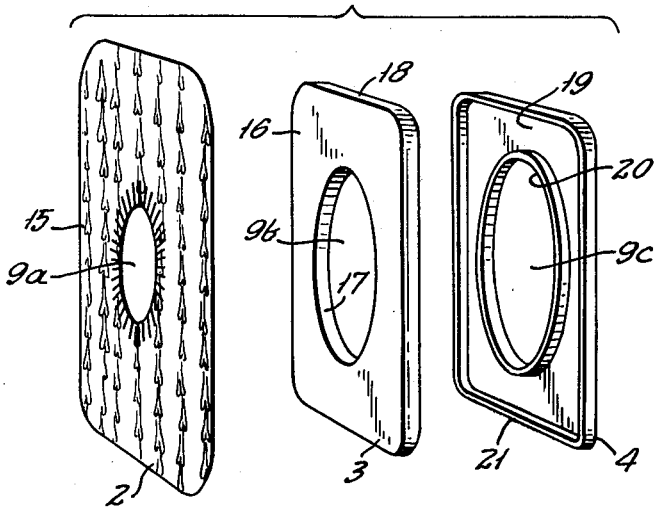
Figure 9:
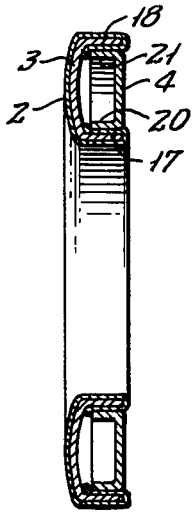
Figure 10:
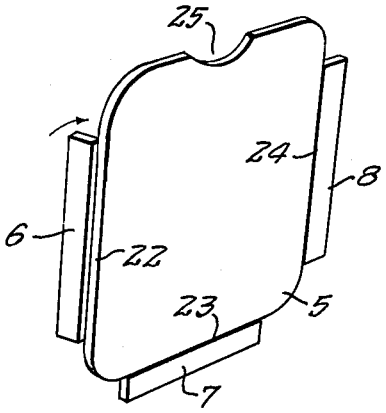
Figure 11:
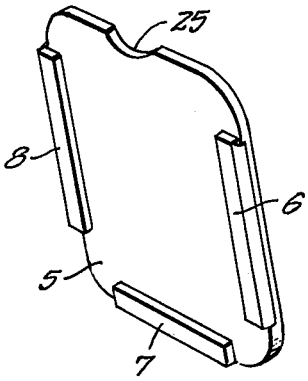
Figure 12:
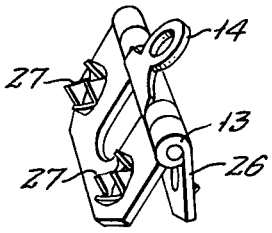
Figure 14:
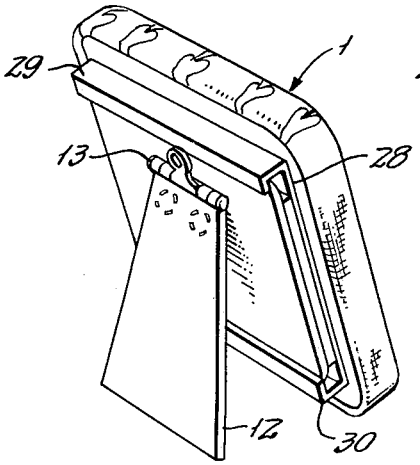
Figure 13:
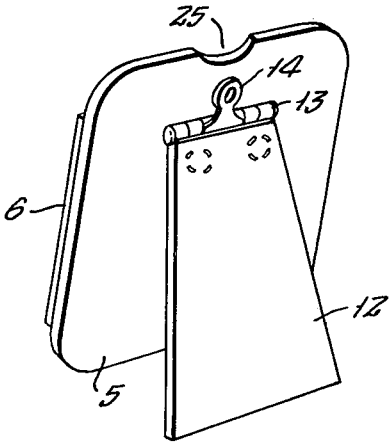
Figure 17:
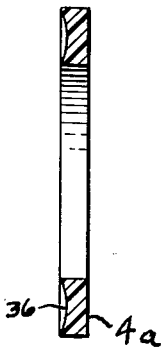
Figure 15:
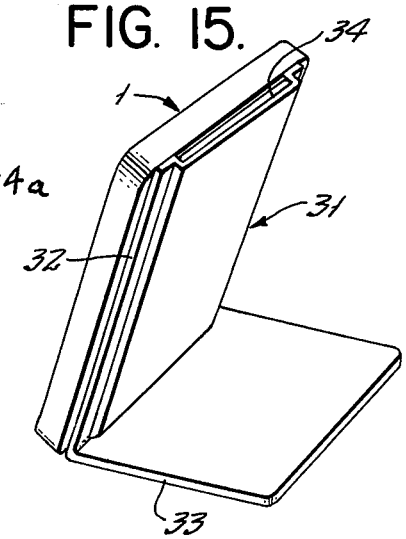
Figure 16:
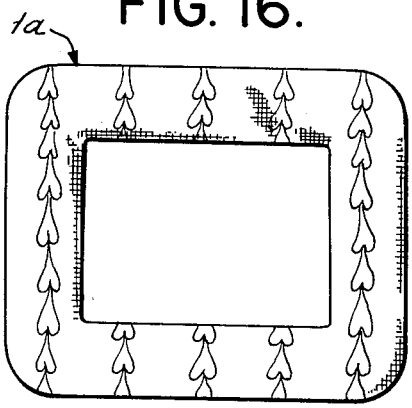

FIGS. 4 and 5 are, respectively, front elevation and cross-sectional views of the front part of the frame of the embodiment shown in FIGS. 1 and 2, FIG. 5 being taken along the line 5—5 shown in FIG. 4;

FIGS. 6 and 7 are, respectively, front elevation and cross-sectional views of the back part of the frame of the embodiment shown in FIGS. 1 and 2, FIG. 7 being taken along the line 7—7 shown in FIG. 6;

FIG. 8 is an exploded, perspective view of the frame parts and the decorative sheet illustrating the positions thereof as they are about to be assembled;

FIG. 9 is a cross-sectional view of the parts and sheet shown in FIG. 8 after they have been assembled;

FIG. 10 is a perspective view of a blank forming part of the supporting means for the frame;

FIG. 11 is a perspective view of the blank shown in FIG. 10 after it has been processed;

FIG. 12 is a perspective view of the hinge forming part of the supporting means for the frame;

FIG. 13 is a perspective view of the assembled supporting means for the frame shown in FIGS. 1 and 2;

FIG. 14 is a perspective view of a modified form of a supporting means for the frame;

FIG. 15 is a perspective view of a further modified form of a supporting means for the frame;

FIG. 16 is a front elevation view of an embodiment of the invention which has a rectangular, rather than square, shape; and FIG. 17 is a cross-sectional view of a modified form of the back part of the frame.

Figure 3:
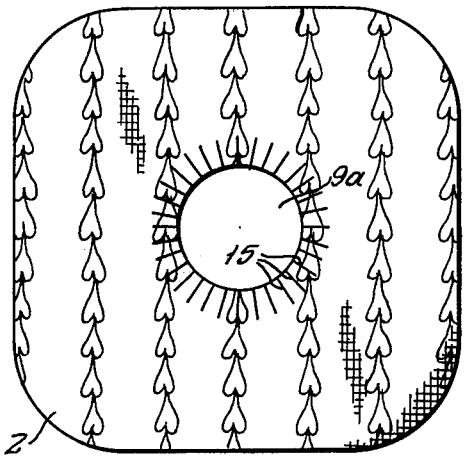
FIG. 3 is a plan view of a decorative sheet which forms part of the embodiment shown in FIGS. 1 and 2.

With reference to FIGS. 1 and 2, the preferred embodiment of the framing device 1 of the invention comprises a decorative covering 2 of flexible sheet material, such as cloth or plastic either having a design thereon, as shown in FIGS. 1, 3 and 8, or having a surface of pleasing appearance, e.g. colored, reflective, suede, etc. The covering 2 is secured to the front face of a frame front part 3 made of a relatively rigid sheet material, such as metal or plastic, by a frame back part 4, made of the same, or a similar, material as the front part 3, edge portions of the covering 2 being received between, and clamped by, rims on the front and back parts 3 and 4 as described hereinafter.

Supporting means for either suspending the framing device from, or supporting the device 1 on a support is adhesively or otherwise secured to the back face of the back part 4. The supporting means comprises a plate 5 of rigid material, such as cardboard, fiberboard, etc., which is spaced from the back surface of the back part 4 by strips 6, 7 and 8 (see FIGS. 2, 10 and 11) which are adhesively secured to the plate 5 and to said back surface. The strips 6–8, the plate 5 and the back surface of the back part 4 define a cavity in line with the openings 9 in the covering 2 and the parts 3 and 4 for receiving an article 10 to be displayed and if desired, a transparent protective sheet or film 11 of glass or plastic.

The plate 5 has a rigid arm 12, which may be made of the same material as the plate 5, secured thereto by a hinge 13, which may be of a restricted opening type, the plate 5 with the arm 12 hingedly secured thereto forming an easel for mounting the device 1 on a horizontal surface. Preferably, the hinge 13 also has a loop portion 14 so that the device 1 may, if desired, be suspended from a support by means of a nail, screw, hook, etc., secured to the support. Also, the hinge 13 and the arm 12 may be omitted if it is merely desired to suspend the device 1, and loop means, such as the loop portion 14, may be secured to the plate 5, the back part 4 or the front part 3.

FIG. 3 illustrates the covering 2 before it has been assembled with the frame parts 3 and 4. The covering 2 may be die cut from a relatively thin sheet of flexible material into a shape which corresponds to, but which is larger than, the shape of the parts 3 and 4. The covering 2 has a central opening 9*a* which is smaller in diameter than the central opening 9*b* in the part 3 (FIG. 4) and is provided with a plurality of radially extending slits 15 to assist in forming the covering 2 around the periphery of the opening 9*b*.

With reference to FIGS. 4 and 5, the front part 3 has a front face 16 and has a pair of rims 17 and 18 extending substantially perpendicular, to the face 16 and in a direction opposite to the direction in which the face 16 faces. The rim 17 extends around the periphery of the opening 9*b* and the rim 18 extends around the periphery of the part 3.

With reference to FIGS. 6 and 7, the back part 4 is similar to the front part 3 but has slightly different dimensions. Thus, the back part 4 has a front face 19, and opening 9*c* and a pair of rims 20 and 21, the rim 20 extending around the periphery of the opening 9*c* and the rim 21 extending around the periphery of the part 4. The inner diameter of the rim 20 is greater than the outer diameter of the rim 17 of the front part 3 by an amount substantially equal, or equal, to twice the thickness of the covering 2. The outer dimensions of the rim 21 are less than the corresponding inner dimensions of the rim 18 of the front part 3 by an amount substantially equal, or equal, to twice the thickness of the covering 2. Accordingly, when the parts 3 and 4 are assembled with each other and the covering 2, as described hereinafter, the edge portions of the covering 2 are engaged by the rims 17, 18, 20 and 21.

The covering 2 and the parts 3 and 4 are assembled in the relationship illustrated in FIG. 8. The covering 2 is applied over the front face 16 of the front part 3 and the portion of the covering 2 containing the slits 15 is moved into engagement with the rim 17 and over the free end thereof. The peripheral edge portions of the covering 2 are moved into engagement with the rim 18 and over the free end thereof. The part 4 is then pressed into place, such as by a foot press. At the same time, or after the parts 3 and 4 are assembled, the rim 18 may be crimped inwardly and the rim 17 may be crimped outwardly to securely engage the portions of the covering 2 which are between the rims. As the part 4 is pressed into place, the covering 2 is stretched and snugly fits the face 16 of the part 3.

The assembly which results from the steps described in connection with FIG. 8 is shown in FIG. 9, and it will be observed that a portion of the covering 2 around the opening 9*a* is folded over the rim 17 and is clamped between the rims 17 and 20. Also, a peripheral portion of the covering 2 is folded over the rim 18 and is clamped between the rims 18 and 21. When the covering 2 and the parts 3 and 4 are assembled as shown and described, they can be separated only with difficulty.

The preferred supporting means for the frame assembly shown in FIG. 9 comprises an easel with a hinge 13 having loop means 14 so that the frame assembly may be supported on a horizontal surface by the easel or may be suspended by the loop means 14. The preferred manner of making the easel comprises die cutting a blank from a sheet of material, such as a stiff board made from paper stock and about 3/32 inches thick, the blank having the configuration illustrated in FIG. 10. The blank comprises a plate 5 having strips 6–8 at three of its side edges. A series of cuts 22–24 extend part way through the thickness to permit the strips 6–8 to be folded over the front face of the plate 5 as illustrated in FIG. 11, the strips 6–8 having a hinge connection to the plate 5 by reason of the uncut portion of the blank. Preferably, the plate 5 has a cut-out 25 for ease in inserting and removing an article 10 to be displayed.

The strips 6–8 are folded over the front face of the plate 5 with adhesive between the abutting surfaces so that the strips 6–8 remain in their folded over positions. Either before or after, and preferably, after, the strips 6–8 are folded over and secured, the hinge 13 is secured to the plate 5. The hinge 13 is of a known type and is constructed so that opening thereof is limited. The hinge 13 have teeth 26 in one portion thereof which are pressed into the plate 5 and are bent over at their ends to retain the hinge 13 on the plate. Teeth 27 are similarly provided on the other portion of the hinge 13 for similarly securing the other portion of the hinge 13 to the arm 12 which may be made from the same material as the plate 5. The assembled easel has the appearance illustrated in FIG. 13.

The easel is then secured to the back part 4, preferably, be applying an adhesive to the front faces of the strips 6–8 and pressing the strips 6–8, secured to the plate 5, against the back face of the part 4.

Instead of adhesively securing the easel to the back part 4 by adhesive, a plate 28 of transparent material may be adhesively secured to the back face of the part 4 as illustrated in FIG. 14. The plate 28 has extensions 29 and 30 which are formed so as to provide grooves into which the easel may be slid as shown in FIG. 14. The use of such a plate avoids the need for a separate sheet or film 11 to protect the article 10.

Another form of supporting means for the frame assembly is illustrated in FIG. 15. The supporting means 31 is in the form of a stand which has a first portion 32 adhesively secured to the back face of the part 4 and a second portion 33 which extends at an acute angle to the portion 32. The means 31 may be molded from a plastics material or may be otherwise formed, and the means 31 is formed so as to provide a cavity 34 for receiving an article 10 and a protective sheet 11.

While preferred embodiments have been disclosed, it will be apparent that various modifications thereof can be made. For example, means other than an adhesive may be used to secure a supporting means to the frame assembly, and the hinge 13 may be secured to the plate 5 and the arm 12 by other fastening means. Also, the rims 17, 18, 20 and 21 could be differently related in size, and the spacing therebetween can be greater than the thickness of the covering material, the rims, in this case, being bent or crimped sufficiently to grip the covering. The frame assembly may have a rectangular shape with a rectangular opening as indicated at 1*a* in FIG. 16 rather than a square periphery with a circular opening as shown in the preceding figures, or may have other shapes such as a heart shape, oval shape, etc. Also, the opening 9 may be different in shape from the periphery of the frame as shown in FIG. 1, and the opening may have various shapes such as square, rectangular, circular, as shown in FIG. 1, oval, heart shaped, etc.

Although both the front part 3 and the back part 4 in the preceding embodiments have rims, one of the parts, the part which fits within the other part, may be made without rims as is illustrated, for example, in FIG. 17. FIG. 17 illustrates a back part 4*a* which corresponds to the back part 4 and fits within the front part 3 in the same manner as the part 4. The part 4*a* may, for example, be made of a plastic material, and preferably, the part 4*a* as a depression 36 for receiving any ends of the covering 2 which may extend thereover. The thickness of the part 4*a*, preferably, is substantially equal to the height of the rims 20 and 21.

What is claimed is:

1. A decorative frame assembly for displaying an article, said assembly comprising a front part with a front face having an opening extending therethrough, a back part substantially co-extensive with said front part and having an opening extending therethrough, said last-mentioned opening corresponding in shape to the shape of the opening in the front part but having a size different from the size of the opening in the front part and said back part being mounted adjacent said front part with the opening in the back part aligned with the opening in the front part, said back part having a peripheral shape corresponding to the peripheral shape of said front part but having a size different from the peripheral size of the front part, a sheet of decorative material covering said front face and extending between said front part and said back part both at the peripheries thereof and at the peripheries of the opening therethrough, at least one said part having a rim thereon around the opening therethrough and extending toward the other part and frictionally engaging said sheet material between said rim and the other part and at least one said part having a rim at the periphery thereof and extending toward the other part and frictionally engaging said sheet material between said last-mentioned rim and said last-mentioned other part, whereby said sheet material is clamped between said front part and said back part both at the peripheries of the openings and at the peripheries of the parts and said parts are maintained adjacent to each other, and supporting means secured to one said part for supporting said frame on a support.

2. A decorative frame assembly as set forth in claim 1 further comprising a transparent sheet material covering the opening in said back part.

3. A decorative frame assembly as set forth in claim 1 wherein said front part has a first rim around its periphery and a second rim around the periphery of the opening therethrough, wherein said back part has a third rim around its periphery and a fourth rim around the periphery of the opening therethrough, said third rim being spaced from said first rim by substantially the thickness of the decorative sheet material and said fourth rim being spaced from said second rim by substantially the thickness of the decorative sheet material and said decorative sheet material extends between said first rim and said third rim and is gripped thereby and extends between said second rim and said fourth rim and is gripped thereby.

4. A decorative frame assembly as set forth in claim 3 wherein said third rim and said fourth rim are both intermediate said first rim and said second rim.

5. A decorative frame assembly as set forth in claim 1, 3 or 4 wherein said supporting means comprises a plate secured to the face of said back part which faces away from said front part, said plate being larger that the opening in the back part and being in spaced relation to said last-mentioned face at least intermediate the edges thereof to provide a cavity between the plate and said back part at the opening in the back part for receiving an article to be displayed.

6. A decorative frame assembly as set forth in claim 5 wherein said supporting means further comprises loop means secured to said plate for suspending said frame from a support.

7. A decorative frame assembly as set forth in claim 5 wherein said supporting means further comprises an arm hingedly secured to said plate to provide an easel for supporting said frame on a horizontal surface.

8. A decorative frame assembly as set forth in claim 5 wherein said plate is secured to said back part by strips intermediate three side edge portions of said plate and said back part.

9. A decorative frame assembly as set forth in claim 8 wherein said strips are extensions of said plate folded back upon a surface of the plate.

10. A decorative frame assembly as set forth in claim 5 further comprising a transparent sheet material in said cavity and covering the opening in said back part.

11. A decorative frame assembly as set forth in claim 1, 3 or 4 wherein said supporting means comprises a plate of transparent material larger than the opening in the back part secured to the face of the back part which faces away from said front part, said plate covering the opening in said back part and having means thereon at a pair of opposite side edges forming a pair of grooves for slidably receiving a further member.

12. A decorative frame assembly as set forth in claim 11 wherein said further member is an easel having side edges slidably received in said grooves.

13. A decorative frame assembly as set forth in claim 1, 3 or 4 wherein said supporting means comprises a stand secured to said back part, said stand comprising a first portion larger than the opening in the back part covering the latter opening and a second portion extending at an acute angle to said first portion, said first portion being spaced from the face of the back part which faces away from the front part at least at the opening in the back part to provide a cavity between said first portion and said last-mentioned face for receiving an article to be displayed.

14. A decorative frame assembly as set forth in claim 1 wherein said front part has a first rim around its periphery and a second rim around the periphery of the opening therethrough, wherein the periphery of said back part is spaced from said first rim by substantially the thickness of the decorative sheet material and the periphery of the opening in said back part is spaced from said second rim by substantially the thickness of the decorative sheet material and said decorative sheet material extends between said first rim and said third rim and is gripped thereby and extends between said second rim and said fourth rim and is gripped thereby.

15. A method of manufacturing a decorative frame for displaying an article, said method comprising:

forming a sheet of decorative, flexible material with a central opening, a front face and a back face, the front face being large relative to the thickness of the sheet;

forming a first part from a sheet of rigid material, said part having a front face which is large relative to the thickness of the latter material, but smaller than the front face of the sheet of decorative material, having a central opening in the front face which is larger than the opening in the sheet of decorative material, and having a first rim and a second rim substantially perpendicular to said face and extending in a direction opposite to the direction in which said face faces, said first rim extending around the periphery of said face and the second rim extending around the periphery of said opening;

forming a second part from rigid material, said second part having a front face which is large relative to the thickness of the latter material, having a central opening in its front face which is substantially equal to the size of the opening in said first part and which has a shape corresponding to the latter opening, the periphery of said second part and the periphery of the opening in said second part having shapes corresponding respectively to the shapes of the first and second rims of the first part and respectively differing in size from the first and second rims of the first part by an amount substantially equal to twice the thickness of the sheet of the decorative material;

applying the sheet of decorative material over the front face of the first part with its front face facing away from the front face of the first part and with first portions thereof extending into the opening of the first part and second portions thereof adjacent the first rim of the first part;

pressing said front part and said second part together with the back face of the first part facing the front face of the second part and with said first portions of the sheet of decorative material between the second rim of said first part and the periphery of the opening of said second part and said second portions of the sheet of decorative material between the first rim of said first part and the periphery of said second part thereby to engage the edges of the sheet of decorative material by the rims and the peripheries of the second part and of the opening therein; and securing supporting means for supporting said frame from a support to one of said parts.

16. Method as set forth in claim 13 wherein at least one of the rims on said first part is crimped to clamp the edges of the sheet of decorative material between the last-mentioned rim and the second part.

17. A method of manufacturing a decorative frame for displaying an article as set forth in claim 15 wherein said second part is formed with a first rim and a second rim substantially perpendicular to its face and extending in the same direction as said face of the second part faces, said last-mentioned first rim extending around the periphery of the face of the second part and said last-mentioned second rim extending around the periphery of the opening in the second part, said last-mentioned first rim and said last-mentioned second having shapes corresponding respectively to the shapes of the first and second rims of the first part and respectively differing in size from the first and second rims of the first part by an amount substantially equal to twice the thickness of the sheet of the decorative material, and wherein said front part and said second part are pressed together with the back face of the first part facing the front face of the second part and with said first portions of the sheet of decorative material between the second rim of said first part and the second rim of said second part and said second portions of the sheet of decorative material between the first rim of said first part and the first rim of said second part thereby to engage the edges of the sheet of decorative material by the rims.

18. Method as set forth in claim 17 wherein at least one of the rims is crimped to clamp the edges of the sheet of decorative material between the rims.

19. Method as set forth in claim 15 wherein said supporting means comprises an easel and further comprising:

forming a blank from rigid material with partial cuts extending alongside but spaced from the edges of the blank to form strips between the cuts and the last-mentioned edges;

folding said strips upon a face of the blank and securing them in the folded position;

hingedly securing an arm to the opposite face of the blank to form said easel; and securing the easel to said second part with the faces of said strips abutting the back face of said second part and with strips at opposite sides of the blank on opposite sides of the opening in said second part.

* * * * *